United States Patent [19]

Meier

[11] Patent Number: 4,560,964

[45] Date of Patent: Dec. 24, 1985

[54] COMPACT STEP TUNED FILTER

[75] Inventor: Paul J. Meier, Westbury, N.Y.

[73] Assignee: Eaton Corporation, Cleveland, Ohio

[21] Appl. No.: 706,730

[22] Filed: Feb. 28, 1985

[51] Int. Cl.[4] ..... H01P 1/203; H01P 7/08

[52] U.S. Cl. ..... 333/202; 333/204; 333/222; 333/246

[58] Field of Search ..... 333/202, 203, 204, 205, 333/206, 207, 219, 222, 245, 246

[56] References Cited

U.S. PATENT DOCUMENTS

| | | | |
|---|---|---|---|
| 3,104,362 | 9/1963 | Matthaei | 333/204 |
| 3,896,402 | 7/1975 | Jackson | 333/204 X |
| 4,418,324 | 11/1983 | Higgins | 333/204 |

OTHER PUBLICATIONS

G. L. Matthaei, L. Young and E. M. T. Jones, "Microwave Filters, Impedance-Matching Networks and Coupling Structures," McGraw-Hill, 1964, pp. 83-104, 175, 221, 440-450, 584-595.

T. G. Bryant and J. A. Weiss, "Parameters of Microstrip Transmission Lines and Coupled Pairs of Microstrip Lines," IEEE Trans., vol. MTT-16, Dec. 1968, pp. 1021-1027.

M. Makimoto and S. Yamashita, "Strip-Line Resonator Filters having Multi-Coupled Sections," Digest of IEEE MTT-S Symposium, May 1983, pp. 92-94.

S. B. Cohn, "Parallel-Coupled Transmission-Line-Resonator Filters", IRE Trans, vol. MTT-6, Apr. 1958, pp. 223-231.

P. A. Kirton and K. K. Pang, "Extending the Realizable Bandwidth of Edge-Coupled Stripline Filters," IEEE Trans, vol. MTT-25, Aug. 1977, pp. 672-676.

B. J. Minnis, "Printed Circuit Coupled-Line Filters for Bandwidths up to and Greater than an Octave," IEEE Trans, vol. MTT-29, Mar. 1981, pp. 215-221.

D. Rubin and A. Hislop, "Millimeter-Wave Coupled Line Filters," Microwave Jour., Oct. 1980, pp. 67, 69-71, 78.

*Primary Examiner*—Marvin L. Nussbaum

*Attorney, Agent, or Firm*—Andrus, Sceales, Starke & Sawall

[57] ABSTRACT

A compact step tuned filter (30, FIG. 6), is provided for passing two or more widely separated microwave frequencies and providing high rejection to signals below the passband, and is particularly useful in miniaturized light weight airborne step tuned mixers and the like. The filter includes input and output sets (39-40, 41-42) of parallel coupled transmission lines providing lumped element capacitors at the lower frequency and matched transmission lines at the higher frequency, and a central transmission line connected between the input and output sets of coupled lines and providing a resonator between the lumped element capacitors at the lower frequency and a matched transmission line at the higher frequency.

6 Claims, 9 Drawing Figures

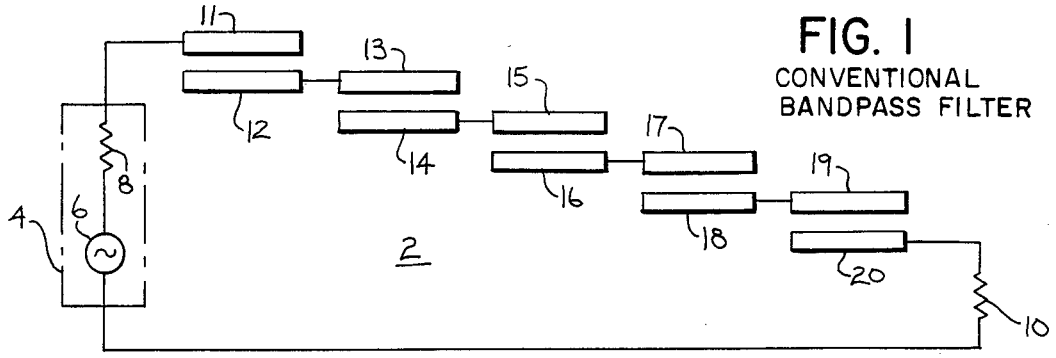
FIG. 1
CONVENTIONAL BANDPASS FILTER
FIG. 2
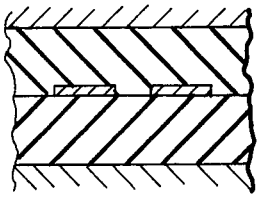
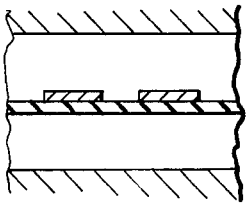
FIG. 3
FIG. 4
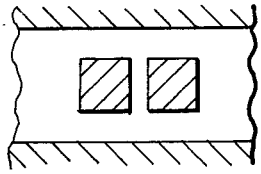
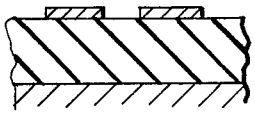
FIG. 5
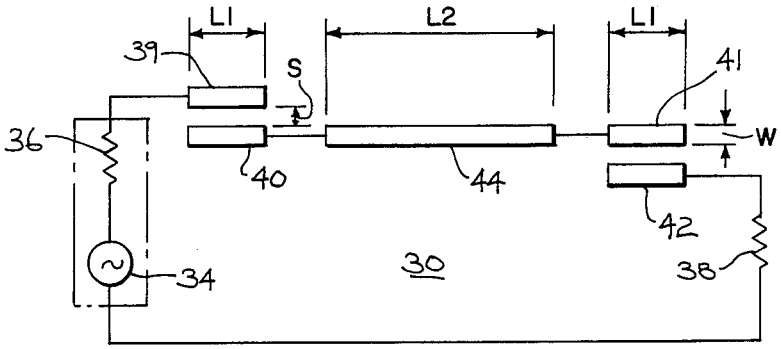
FIG. 6
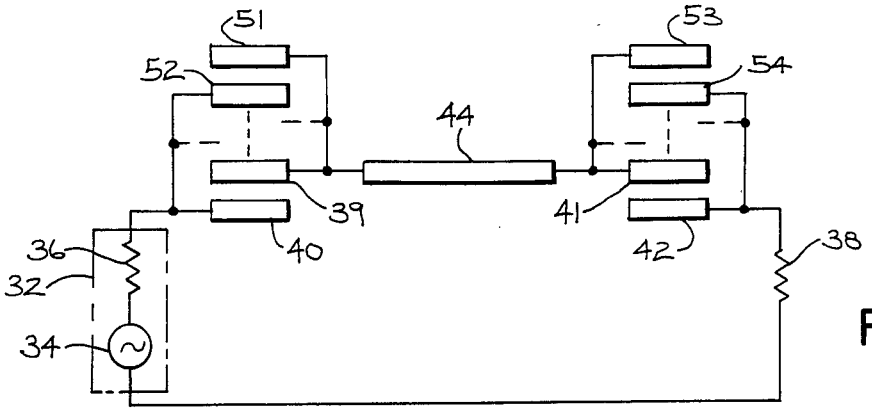
FIG. 9

COMPACT STEP TUNED FILTER

BACKGROUND AND SUMMARY

The invention relates to microwave frequency filters, particularly those usable in miniaturized light-weight airborne step tuned mixers.

A common receiver component is the down-converter, which mixes the received radio frequency RF signal and a local oscillator LO signal to provide an intermediate IF signal output. A filter is often required in such mixers, to prevent harmful interaction between the LO and IF circuits.

When the receiver must cover a wide bandwidth, it is often helpful to change the LO frequency in discrete steps. If the spacing between the LO steps is small and a large guardband exists between the LO and IF bands, conventional filtering techniques are adequate, G. L. Matthaei, L. Young and E. M. T. Jones, "Microwave Filters, Impedance-Matching Networks and Coupling Structures," McGraw-Hill, 1964, pp. 83–104, 440–450 and 584–595. However, if the LO bandwidth is large and the spacing between the LO and IF bands is narrow, conventional filters require many sections, and the filter can become large and heavy. For airborne receivers, where size and weight must be minimized, conventional multi-section filters are undesirable.

The present invention addresses and solves the need for size and weight reduction in airborne step tuned wideband applications, though the invention is of course not limited thereto.

BRIEF DESCRIPTION OF THE DRAWINGS

1. Prior Art

FIG. 1 shows a conventional bandpass filter.

FIGS. 2–5 show various transmission line structures used in the prior art and usable in the present invention.

2. The Present Invention

FIG. 6 shows a compact step tuned filter in accordance with the invention.

Figure 7:
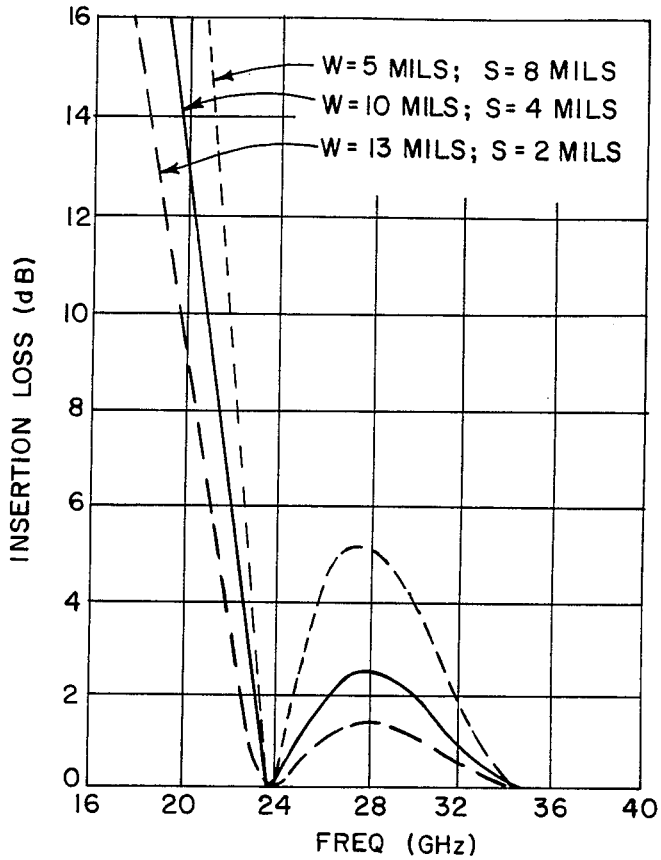

FIG. 7 graphically illustrates calculated filter response.

Figure 8:
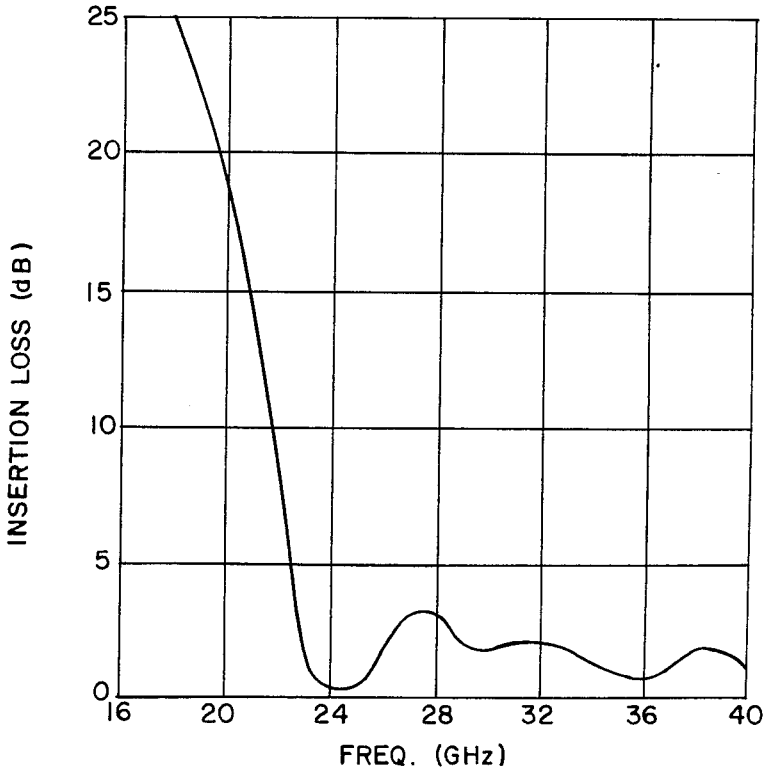

FIG. 8 graphically illustrates measured filter response.

FIG. 9 illustrates an alternate embodiment of FIG. 6.

DESCRIPTION OF PRIOR ART

The conventional bandpass filter 2 of FIG. 1 transmits signals from source 4, having generator 6 and resistive load 8, to termination load 10 in the passband and rejects signals above and below the passband. A series of transmission lines are arranged such that successive strips are parallel along a distance of a quarter wavelength, such as 11-12, 13-14, 15-16, 17-18 and 19-20. Well known synthesis techniques are used to determine the dimensions of the coupler lines, S. B. Cohn, "Parallel-Coupled Transmission-Line-Resonator Filters," IRE Trans, Vol. MTT-6, pp. 223–231, April 1958 outlining the basic design approach, which is useful for bandwidths up to 30 percent. Various transmission line structures may be used, for example stripline, or suspended stripline, FIGS. 2 and 3, Matthaei et al, pg. 175, and slabline or microstrip, FIGS. 4 and 5, T. G. Bryant and J. A. Weiss, "Parameters of Microstrip Transmission Lines and Coupled Pairs of Microstrip Lines," IEEE Trans Vol. MTT-16, December 1968.

The number of coupled lines that must be used is determined by the width of the passband, the spacing between the passband and the stopband, the passband ripple and the specified stopband rejection. For wider bandwidths, more accurate mapping equations are available, G. L. Matthaei et al, pp. 83–104, 584–595. Alternative approaches for dealing with stringent dimensional requirements include the use of: input/output transformers, P. A. Kirton and K. K. Pang, "Extending the Realizable Bandwidth of Edge-Coupled Stripline Filters," IEEE Trans Vol. MTT-25, pp. 672–676, August 1977; intermediate "redundant" lines, B. J. Minnis, "Printed Circuit Coupled-Line Filters for Bandwidths Up to and Greater Than an Octave," IEEE Trans Vol. MTT-29, pp. 215–222, March 1981; and multiple coupled lines, M. Makimoto and S. Yamashita, "Strip-Line Resonator Filters Having Multi-Coupled Sections", Digest of IEEE MTT-S Symposium, pp. 92–94, MAY 1983. All these approaches, however, require many sections for stringent wideband applications.

An illustrative example is given for the following conditions: LO frequencies of 24 and 36 gigahertz; maximum loss at LO frequencies of 0.5 dB and IF rejection of 20 dB or better below 18 gigahertz. These conditions apply to a wideband $K_a$-band receiver which could be used in communication links or airborne receivers. Applying standard design techniques of the noted Matthaei et al reference requires the use of four sections and an axial length of more than 400 mils, if constructed in suspended substrate stripline having an equivalent dielectric constant of 1.5. This dimension is large relative to the other components found in a stripline $K_a$-band mixer.

DESCRIPTION OF THE INVENTION

FIG. 6 shows a compact step tuned filter 30 in accordance with the invention transmitting signals from source 32, including generator 34 and resistive load 36, to termination load 38.

Filter 30 passes two or more widely separated frequencies, provides high rejection to signals below the passband, and minimizes the size and weight of the circuit. Filter 30 includes an input set of parallel coupled transmission lines 39-40 of axial length L1 providing a lumped element capacitor at the lower of the two frequencies, such as 24 gigahertz in the above example, and a matched transmission line at the higher of the frequencies, such as 36 gigahertz in the above example. Filter 30 also includes an output set of parallel coupled transmission lines 41-42 providing a lumped element capacitor at the lower frequency, such as 24 gigahertz, and a matched transmission line at the higher frequency, such as 36 gigahertz. Filter 30 further includes a central transmission line 44 of axial length L2 connected between the input and output sets of coupled lines 39-40 and 41-42 and providing a resonator between the lumped element capacitors at the lower frequency and a matched transmission line at the higher frequency. At the lower frequency, the input and output coupled lines 39-40 and 41-42 and the central line 44 provide a single section bandpass filter. At and above the higher frequency, the input and output coupled lines 39-40 and 41-42 and the central line 44 provide a matched distributed transmission line.

In the disclosed embodiment, axial length L1 is slightly less than a quarter wavelength at the iupper frequency. The even and odd mode impedances of the coupled lines are chosen such that $(Z_{oe}-Z_{oo})/2=50$ ohms, to achieve the desired match in a 50 ohm system, and the absolute value of $Z_{oe}$ is varied to control the stopband rejection.

FIG. 7 shows the calculated response of the present filter. Three examples are given, one in solid line, one long dashed line and one in short dashed line, with the noted parameters for width W of the transmission lines and spacing S chosen to satisfy a 50 ohm matching condition, i.e., $Z_{oe}-Z_{oo}=100$ ohms. To maximize the stopband rejection, L1 was fixed at 55 mils, the minimum value which provides an adequate guardband below 36 gigahertz in the noted example. The resonator length L2 was chosen to provide a match at 24 gigahertz. The curves illustrate the trade-off obtained between stopband rejection and passband ripple. In step tuned applications, the LO frequency is changed in discrete steps, and there is no need to specify the loss at frequency between 24 and 36 gigahertz. insertion loss at frequencies between the steps is of little or no concern. By adjusting the dimensions of the coupled lines, the ripple between the frequencies to be passed can be increased, thereby increasing the stopband rejection without circuit complexity. The increased ripple at unused frequencies is not a concern in step tuned mixers. A conventional filter as in FIG. 1 provides low loss at all frequencies across a wide band and is unnecessarily complex for step tuned applications, i.e., it is not necessary to provide low loss at the frequencies between the two step tuned LO frequencies.

In variously constructed circuits in accordance with FIG. 6, filters were printed on a 10 mil suspended stripline in housings with a ground plane spacing of 62 mils. Below 26.5 gigahertz, the filters were embedded between coax transitions. Low reflection waveguide/coax adapters were used in the band of 18–26.5 gigahertz. For tests in the band of 26.5–40 gigahertz, the filters were integrated with wave guide/probe transitions, D. Rubin and A. Hisplop, "Millimeter-Wave Coupled Line Filters," Microwave Jour., pp. 67–68, October 1980. Preliminary tests showed that it was necessary to reduce the physical length L1 of the coupled lines to 40 mils, to compensate for fringing capacitance.

FIG. 8 shows the measured response to the invention. As desired, adequate rejection of 25 dB was obtained at 18 gigahertz, and the insertion loss was low, 0.5 dB, at 24 and 26 gigahertz. The physical length of the filter is no greater than about one wavelength, 0.23 inch, which is about half that required for a conventional four section design otherwise required as noted above.

FIG. 9 shows an alternate embodiment of FIG. 6 and like reference numerals are used where appropriate to facilitate clarity. The input set of coupled lines includes a plurality of parallel pairs such as 39-40, 51-52 and so on, of parallel coupled transmission lines providing a plurality of parallel lumped element capacitors at the lower frequency and a plurality of parallel matched transmission lines at the higher frequency. The output set of coupled lines includes a plurality of pairs such as 41-42, 53-54 and so on, of parallel coupled transmission lines providing a plurality of parallel lumped element capacitors at the lower frequency and a plurality of parallel matched transmission lines at the higher frequency. As in FIG. 6, the total axial length of the input, output and central lines is no greater than about one wavelength at the lower frequency. The sets of plural parallel pairs of coupled lines provides greater design flexibility, M. Makimoto and S. Yamashita, "Strip-Line Resonator Filters for Bandwidths Up to and Greater Than an Octave," Digest of IEEE MTT-S Symposium, pp. 92–94, May 1983.

The invention requires only two sets of coupled lines, input and output. The length of these coupled lines is shorter than the quarter wave dimension used in conventional parallel coupled filters because L1 is well below a quarter wavelength at the center of the LO band.

It is recognized that various alternatives and modifications are possible within the scope of the appended claims.

I claim:

1. A microwave frequency filter comprising in combination:

an input set of parallel coupled transmission lines providing a lumped element capacitor at one frequency and a matched transmission line at another frequency;

an output set of parallel coupled transmission lines providing a lumped element capacitor at said one freqency and a matched transmission line at said other frequency; and a central transmission line connected between said input and output sets of coupled lines and providing a resonator between said lumped element capacitors at said one frequency and a matched transmission line at said other frequency.

2. The invention according to claim 1 wherein:

said input and output sets of coupled lines are about equal in length;

said central resonator transmission line is about twice as long as each of said input and output sets of coupled lines;

at said one frequency, said input and output coupled lines and said central line provide a bandpass filter; and at said other frequency, said input and output coupled lines and said central line provide a matched distributed transmission line.

3. A compact step tuned filter, usable in miniaturized light-weight airborne step tuned mixers and the like, for passing two or more widely separated frequencies and providing high rejection to signals below the passband, comprising in combination:

an input set of parallel coupled transmission lines providing a lumped element capacitor at the lower of said frequencies and a matched transmission line at the higher of said frequencies;

an output set of parallel coupled transmission lines providing a lumped element capacitor at said lower frequency and a matched transmission line at said higher frequency; and a central transmission line connected between said input and output sets of coupled lines and providing a resonator between said lumped element capacitors at said lower frequency and a matched transmission line at said higher frequency, such that at said lower frequency, said input and output coupled lines and said central line provide a bandpass filter, and such that at said higher frequency, said input and output coupled lines and said central line provide a matched distributed transmission line.

4. The invention according to claim 3 wherein the filter is subject to insertion loss at frequencies between said lower and higher frequencies.

5. The invention according to claim 3 wherein the total axial length of said input, output and central lines is no greater than about one wavelength at said lower frequency.

6. The invention according to claim 5 wherein:

said input set of coupled lines comprises a plurality of parallel pairs of parallel coupled transmission lines providing a plurality of parallel lumped element capacitors at said lower frequency and a plurality of parallel matched transmission lines at said higher frequency;

said output set of coupled lines comprises a plurality of parallel pairs of parallel coupled transmission lines providing a plurality of parallel lumped element capacitors at said lower frequency and a plurality of parallel matched transmission lines at said higher frequency; and the total axial length of said input, output and central lines is no greater than about one wavelength at said lower frequency.

* * * * *

UNITED STATES PATENT AND TRADEMARK OFFICE

CERTIFICATE OF CORRECTION

PATENT NO. : 4,560,964

DATED : December 24, 1985

INVENTOR(S) : Paul J. Meier

It is certified that error appears in the above-identified patent and that said Letters Patent is hereby corrected as shown below:

Column 2, line 65, Cancel "iupper" and substitute therefor ---upper---

Column 3, line 43, Cancel "to" and substitute therefor ---of---

Column 3, line 46, Cancel "26" and substitute therefor ---36---

Signed and Sealed this

*Twenty-ninth* Day of *April 1986*

[SEAL]

*Attest:*

DONALD J. QUIGG

*Attesting Officer*

*Commissioner of Patents and Trademarks*